US012716195B2

(12) United States Patent
Kovalick et al.

(10) Patent No.: US 12,716,195 B2
(45) Date of Patent: Aug. 25, 2026

(54) SCARIFIER SYSTEM FOR MACHINE

(71) Applicant: Caterpillar Inc., Peoria, IL (US)

(72) Inventors: Benjamin Kovalick, Chillicothe, IL (US); David L. Cox, Monticello, IL (US); Chao Chang, Wuxi (CN); Grant V. Kocher, Mount Zion, IL (US)

(73) Assignee: Caterpillar Inc., Peoria, IL (US)

( * ) Notice: Subject to any disclaimer, the term of this patent is extended or adjusted under 35 U.S.C. 154(b) by 1079 days.

(21) Appl. No.: 17/659,698

(22) Filed: Apr. 19, 2022

(65) Prior Publication Data

US 2023/0332376 A1 Oct. 19, 2023

(51) Int. Cl.
*E02F 5/32* (2006.01)
*E02F 3/76* (2006.01)

(52) U.S. Cl.
CPC ..... *E02F 5/32* (2013.01); *E02F 3/76* (2013.01); *E02F 3/7604* (2013.01)

(58) Field of Classification Search
CPC ... E02F 5/32; E02F 5/102; E02F 5/106; E02F 3/7604; E02F 3/8152; E02F 9/2875; E01C 23/121
USPC ..... 172/197, 198, 200
See application file for complete search history.

(56) References Cited

U.S. PATENT DOCUMENTS 37,234 A * 12/1862 Kelsey ..... E02F 3/7604 172/197
142,755 A * 9/1873 Wortham ..... E02F 3/7604 172/197
245,456 A * 8/1881 Deniston ..... A01B 49/02 172/198
1,099,290 A * 6/1914 Fitzgerald ..... A01B 31/00 172/766
1,757,418 A * 5/1930 Arthur ..... A01B 19/02 172/198
1,853,212 A * 4/1932 Kerber ..... E02F 3/7604 172/691
2,222,071 A * 11/1940 Gustafson ..... E02F 9/2875 172/762
2,354,560 A * 7/1944 Troup ..... E02F 3/7604 172/695

(Continued)

FOREIGN PATENT DOCUMENTS

CN 202610868 12/2012
CN 102359137 7/2013
CN 104929180 9/2017

*Primary Examiner* — Christopher J Sebesta
*Assistant Examiner* — Audrey L Lusk

(57) ABSTRACT

A carriage for a scarifier system of a machine includes a body portion having a leading edge, a trailing edge, and a first height. The body portion includes a first surface and a second surface spaced apart from the first surface, such that the first height of the body portion is defined between the first surface and the second surface. The body portion further includes a first side surface connecting the first surface and the leading edge. The body portion includes a second side surface connecting the second surface and the leading edge. At least one of the first side surface and the second side surface includes a beveled profile. The carriage also includes a plurality of shank attachment portions fixedly coupled to the body portion. Each shank attachment portion extends from the second surface of the body portion. Each shank attachment portion defines a second height.

20 Claims, 5 Drawing Sheets

(56) References Cited

U.S. PATENT DOCUMENTS

| | | | | | |
|---|---|---|---|---|---|
| 2,517,426 | A * | 8/1950 | Hall | E02F 5/32 | 172/691 |
| 3,058,243 | A * | 10/1962 | Mcgee | E02F 3/8155 | 172/197 |
| 3,097,439 | A * | 7/1963 | Calkin | E02F 9/2875 | 37/446 |
| 3,141,508 | A * | 7/1964 | Eberhart | A01B 13/08 | 172/744 |
| 3,394,765 | A * | 7/1968 | Davis | E02F 5/32 | 172/744 |
| 3,835,932 | A * | 9/1974 | Mitchell | E02F 3/7609 | 172/197 |
| 4,219,947 | A * | 9/1980 | Paladino | E02F 5/102 | 172/683 |
| 5,211,247 | A * | 5/1993 | Johnsen | A01B 31/00 | 172/197 |
| 8,490,711 | B2 | 7/2013 | Polumati | | |
| 9,243,382 | B2 | 1/2016 | Yamazaki | | |
| 10,590,625 | B2 | 3/2020 | Burnette et al. | | |
| 10,774,503 | B2 * | 9/2020 | Kovalick | E02F 3/7645 | |
| 2002/0144828 | A1 * | 10/2002 | Keigley | A01B 31/00 | 172/197 |
| 2003/0066664 | A1 * | 4/2003 | Matthews | E02F 5/32 | 172/699 |
| 2013/0087354 | A1 * | 4/2013 | Jorgensen | E02F 5/32 | 172/663 |
| 2021/0230830 | A1 | 7/2021 | Kovalick et al. | | |

* cited by examiner

SCARIFIER SYSTEM FOR MACHINE

TECHNICAL FIELD

The present disclosure relates to a scarifier system associated with a machine, and more particularly, to a carriage for the scarifier system of the machine.

BACKGROUND

A machine, such as a motor grader, may be used in construction and maintenance of various ground surfaces, such as, roads. The motor grader may be used to displace, distribute, and level materials, such as, soil, gravel, snow, and the like. The motor grader typically includes one or more implements for performing such tasks. For example, the motor grader may include blade systems, such as, a drawbar-circle-moldboard (DCM) system, a ripper, a scarifier system, and the like. The scarifier system is generally mounted between the DCM system and a pair of front wheels of the motor grader.

In some applications, motor graders may have limited availability of tractive force to push the scarifier system on the ground surface. In an example, tire slip of the motor grader may limit the tractive force to push the scarifier system. In other examples, factors, such as, a weight of the motor grader, power, traction, and ground conditions may also affect the tractive force availability.

The scarifier system typically includes a carriage, a number of shanks, and a number of teeth, such that each tooth is coupled to a corresponding shank. The teeth may engage with the ground surface to cut or scarify the ground surface. During an operation, such as a cutting operation, material may build-up in front of the scarifier system. A conventional carriage associated with the scarifier system includes a thick box shaped section having a flat front surface. Due to the design of the carriage, a large amount of material may accumulate on the carriage. The accumulation of the material on the carriage may increase the weight of the motor grader, may add resistance to the movement of the scarifier system, and may also increase the push force being experienced by the scarifier system.

Typically, the tractive force is a combination of the push force and the cut force of the scarifier system. An increase in the push force may reduce a cut force of the scarifier system, thereby limiting an ability of the scarifier system to dig deeper and faster. The increase in the push force caused due to the material build-up may reduce the efficiency of the scarifier system and may also affect the fuel efficiency of the motor grader, which may not be desirable.

CN104929180 describes a land leveler and a scarifier thereof and belongs to the field of engineering machines. The scarifier mainly comprises a rocker support. A rocker is hinged to the upper portion of the rocker support. The lower portion of the rocker support is fixedly connected with a soil loosening support. Soil loosening harrow teeth are arranged at the bottom of the soil loosening support. Supporting arms are arranged on the two sides of the soil loosening support respectively. The two ends of the rocker are fixedly connected with an oil cylinder and one end of a pull rod. The other end of the oil cylinder is fixedly connected with an oil cylinder fixing base. The other end of the pull rod is fixedly connected with the soil loosening support. The scarifier is arranged between a front axle of the land leveler and a scraper knife working device. The land leveler is good in cutting vision, the steering performance of front wheels is not affected, the soil loosening, and leveling effects are good, and the working efficiency is high. The land leveler and the scarifier thereof are mainly used for leveling of roads and farmland.

SUMMARY OF THE DISCLOSURE

In an aspect of the present disclosure, a carriage for a scarifier system of a machine is provided. The carriage includes a body portion having a leading edge, a trailing edge, and a first height. The body portion includes a first surface. The body portion also includes a second surface spaced apart from the first surface, such that the first height of the body portion is defined between the first surface and the second surface. The body portion further includes a first side surface connecting the first surface and the leading edge. The body portion includes a second side surface connecting the second surface and the leading edge. At least one of the first side surface and the second side surface includes a beveled profile. The carriage also includes a plurality of shank attachment portions fixedly coupled to the body portion. Each shank attachment portion extends from the second surface of the body portion. Each shank attachment portion defines a second height.

In another aspect of the present disclosure, a carriage for a scarifier system of a machine is provided. The carriage includes a body portion having a leading edge, a trailing edge, and a first height. The body portion includes a first surface. The body portion also includes a second surface spaced apart from the first surface, such that the first height of the body portion is defined between the first surface and the second surface. The body portion further includes a first side surface connecting the first surface and the leading edge. The body portion includes a second side surface connecting the second surface and the leading edge. The carriage also includes a plurality of shank attachment portions fixedly coupled to the body portion. Each shank attachment portion extends from the second surface of the body portion. The plurality of shank attachment portions are spaced apart in a direction perpendicular to the first height.

In yet another aspect of the present disclosure, a carriage for a scarifier system of a machine is provided. The carriage includes a body portion having a leading edge, a trailing edge, and a first height. The body portion includes a first surface. The body portion also includes a second surface spaced apart from the first surface, such that the first height of the body portion is defined between the first surface and the second surface. The body portion further includes a first side surface connecting the first surface and the leading edge. The body portion includes a second side surface connecting the second surface and the leading edge. At least one of the first side surface and the second side surface includes a beveled profile. The carriage also includes a plurality of shank attachment portions fixedly coupled to the body portion. Each shank attachment portion extends from the second surface of the body portion. Each shank attachment portion defines a second height. The carriage further includes a plurality of shank retention elements fixedly coupled to the body portion. Each shank retention element extends from the first surface of the body portion.

Other features and aspects of this disclosure will be apparent from the following description and the accompanying drawings.

DETAILED DESCRIPTION

Figure 1:
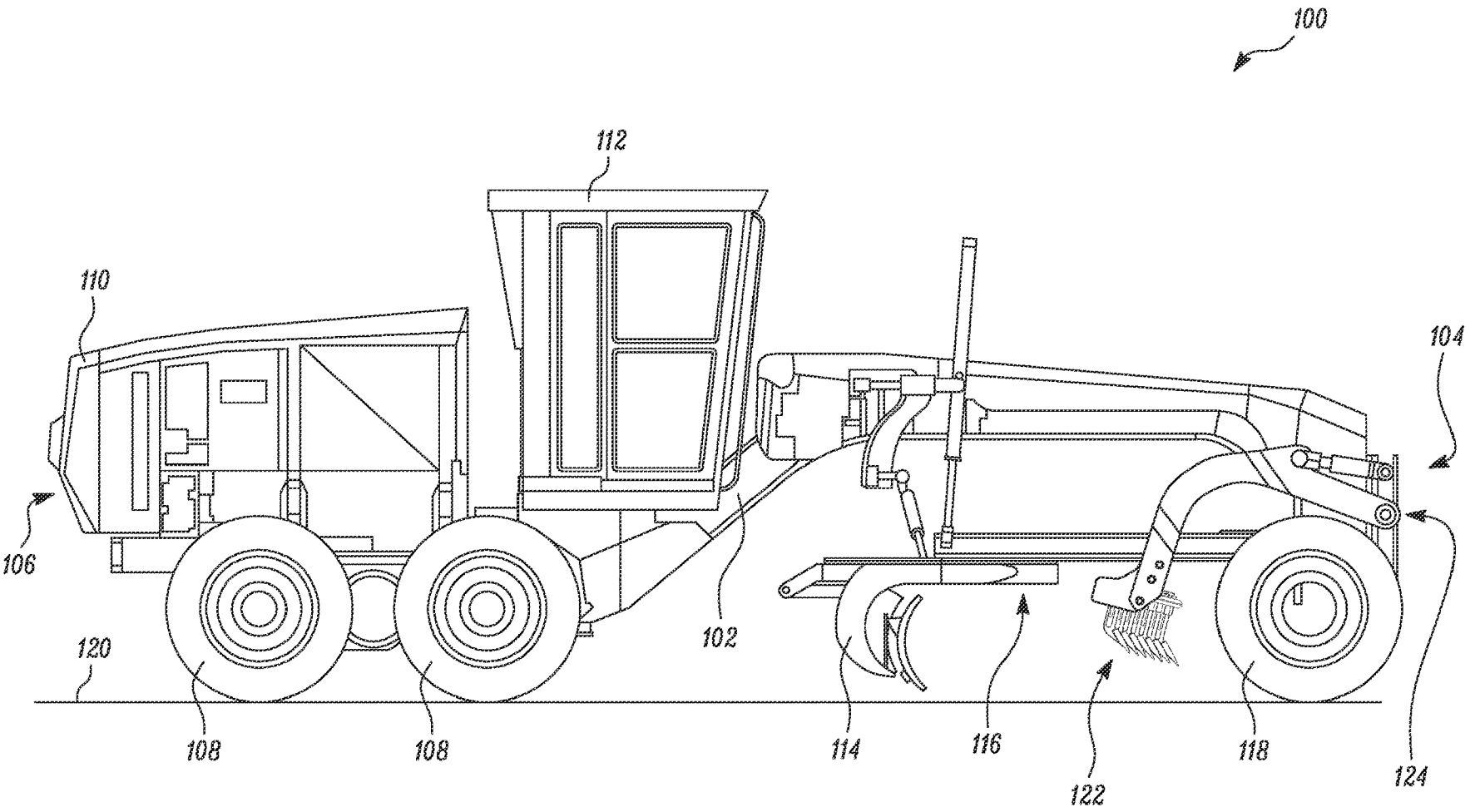
FIG. 1 is a schematic side view of a machine, according to an embodiment of the present disclosure.

Wherever possible, the same reference numbers will be used throughout the drawings to refer to the same or like parts. Referring to FIG. 1, a side view of an exemplary machine 100 is illustrated. As shown in FIG. 1, the machine 100 is a motor grader. Although the motor grader is depicted herein, the present disclosure is not limited to a type of machine 100, for example, a construction machine having a scarifier system. The machine 100 may operate on a ground surface 120 to flatten uneven surfaces, such as, during a grading process prior to road construction, to cut/dig the ground surface 120, and/or for moving of snow, debris, and so on, without any limitations.

The machine 100 includes a frame 102. The frame 102 defines a front end 104 and a rear end 106. Further, the machine 100 includes two pairs of rear wheels 108 disposed proximate to the rear end 106 and one pair of front wheels 118 disposed proximate to the front end 104. The front wheels 118 and the rear wheels 108 allow movement of the machine 100 on the ground surface 120. The frame 102 supports various components of the machine 100, such as, a power source (not shown) disposed within an enclosure 110, an operator cabin 112, the front wheels 118, the rear wheels 108, etc. The power source may be an engine, such as an internal combustion engine, an electric source of power, and the like. The engine may include a gasoline engine, a diesel engine, a natural gas engine, and the like. The power source may supply output power to various components of the machine 100 for operation thereof.

Further, the machine 100 includes the operator cabin 112. An operator of the machine 100 may sit or stand in the operator cabin 112 for performing one or more vehicle operations. The operator cabin 112 may include a user interface (not shown). The user interface may include input and output devices for controlling one or more machine components. The machine 100 further includes a work implement 114. The work implement 114 may be used to perform work operations, such as, grading or snow removal. The work implement 114 is supported by a drawbar-circle-moldboard (DCM) system 116.

As illustrated in FIG. 1, the machine 100 includes a scarifier system 122. The scarifier system 122 is disposed proximate to the front end 104 of the frame 102. The scarifier system 122 is disposed between the work implement 114 and the front wheels 118. The scarifier system 122 may engage with the ground surface 120 to dig, cut, or break up the ground surface 120. Moreover, in some examples, the scarifier system 122 may also be used to spread a windrow of material laid down by, for example, a dump truck in road construction and maintenance applications.

Figure 2:
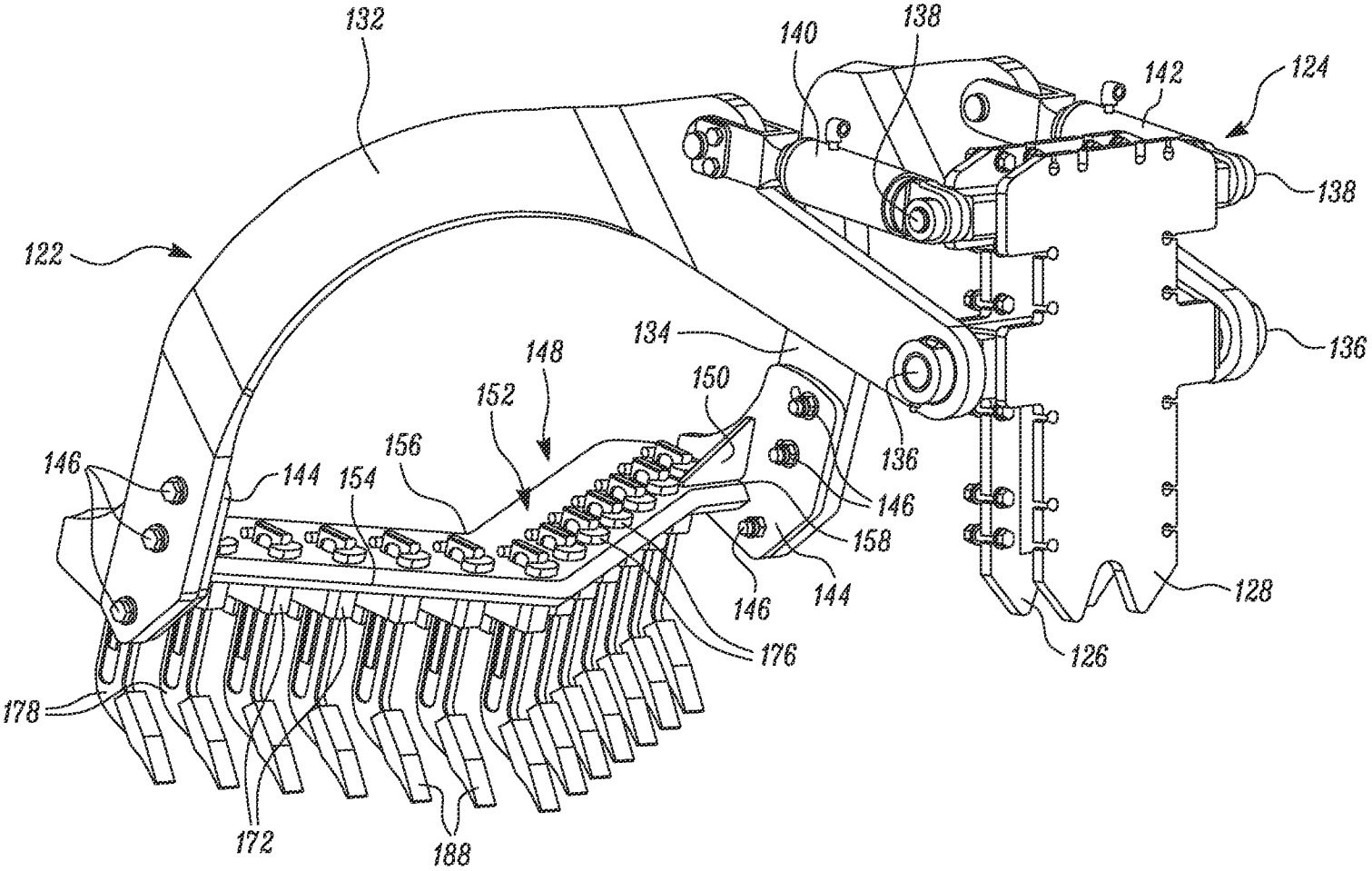
FIG. 2 is a perspective view of a scarifier system associated with the machine of FIG. 1, according to an embodiment of the present disclosure.

Referring to FIG. 2, a perspective view of the scarifier system 122 associated with the machine 100 is illustrated, in accordance with an embodiment of the present disclosure. The scarifier system 122 is coupled to the machine 100 by an attachment system 124. The attachment system 124 includes a first plate member 126 and a second plate member 128. The first plate member 126 and the second plate member 128 couple the scarifier system 122 with the frame 102 (see FIG. 1).

The scarifier system 122 also includes a first arm 132 and a second arm 134 spaced from the first arm 132. The first and second arms 132, 134 have similar shape and size. The first and second arms 132, 134 have an arcuate shape. Each of the first and second arms 132, 134 are pivotably coupled to the first and second plate members 126, 128, respectively, via corresponding first pin members 136 and corresponding second pin members 138. The scarifier system 122 further includes a first actuator 140 and a second actuator 142. The first actuator 140 is coupled between the first arm 132 and the attachment system 124. The second actuator 142 is coupled between the second arm 134 and the attachment system 124. The first and second actuators 140, 142 may facilitate a movement of the scarifier system 122 relative to the attachment system 124 or the frame 102. In various examples, the first actuator 140 and the second actuator 142 may include a hydraulic actuator, a pneumatic actuator, and the like.

Further, the scarifier system 122 includes a pair of coupling plates 144. The coupling plates 144 allow coupling of the scarifier system 122 with the frame 102 (see FIG. 1) of the machine 100. Each coupling plate 144 is coupled with the first and second arms 132, 134, respectively, by a number of fastening elements 146. In the illustrated example of FIG. 2, each coupling plate 144 is coupled to the first and second arms 132, 134, respectively, by three fastening elements 146. The fastening elements 146 may include screws, bolts, pins, dowels, and the like.

The scarifier system 122 also includes a carriage 148. The scarifier system 122 further includes a number of shanks 178 coupled to the carriage 148. Further, the scarifier system 122 includes a number of teeth 188 that engage with the ground surface 120 (see FIG. 1). Each tooth 188 from the number of teeth 188 is coupled to a corresponding shank 178 from the number of shanks 178. In some examples, each tooth 188 from the number of teeth 188 may couple to the corresponding shank 178 through fastening means (not shown), such as, screws, bolts, pins, dowels, and the like.

Further, the carriage 148 may be integrally coupled to the pair of coupling plates 144 (e.g., through a joining process, such as welding) without any limitations. Additionally, the scarifier system 122 further includes two wedge-shaped plates 150 (only one of which is illustrated herein). Each plate 150 may be integrally coupled to the carriage 148 and a corresponding coupling plate 144 (e.g., through a joining process, such as welding) without any limitations. The plates 150 may provide additional strength to the connection between the carriage 148 and the corresponding first and second arms 132, 134 via the corresponding coupling plates 144.

The carriage 148 includes a body portion 152. The body portion 152 includes a continuous plate member having a substantially V-shaped configuration (top view). In other examples, the body portion 152 may include a continuous plate member having a substantially straight configuration. In the illustrated example of FIG. 2, the carriage 148 includes a solid-plate shaped structure (e.g., having lateral dimensions exceeding a vertical height thereof). The body portion 152 has a leading edge 154, a trailing edge 156, and a first height "H1". The leading edge 154 and the trailing edge 156 are disposed opposite to each other. The body portion 152 also has lateral ends 158 (only one of which is illustrated herein). The pair of coupling plates 144 are coupled to corresponding lateral ends 158 of the body portion 152.

Figure 3:
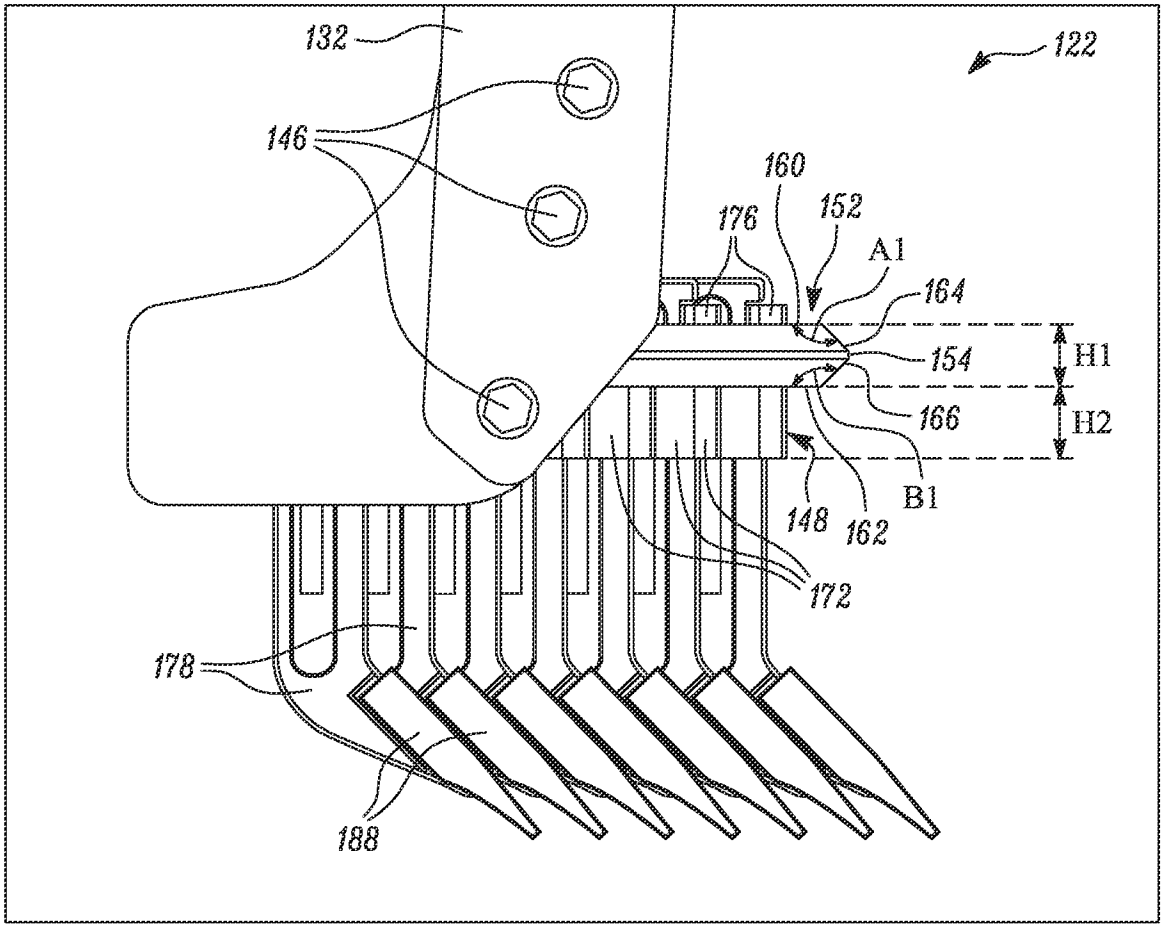
FIG. 3 is a side view of a carriage associated with the scarifier system of FIG. 2, according to an embodiment of the present disclosure.

Referring now to FIG. 3, a side view of the carriage 148 of the scarifier system 122 is illustrated. The body portion 152 includes a first surface 160. The body portion 152 also includes a second surface 162 spaced apart from the first surface 160, such that the first height "H1" of the body portion 152 is defined between the first surface 160 and the second surface 162. The first and second surfaces 160, 162 have a generally planar profile.

The body portion 152 also includes a first side surface 164 connecting the first surface 160 and the leading edge 154. The first side surface 164 is inclined with respect to the first surface 160 by a first angle "A1". The first angle "A1" may be equal to or greater than 90 degrees. The body portion 152 further includes a second side surface 166 connecting the second surface 162 and the leading edge 154. The second side surface 166 is inclined with respect to the second surface 162 by a second angle "B1". The second angle "B1" may be equal to or greater than 90 degrees. Further, at least one of the first side surface 164 and the second side surface 166 includes a beveled profile. Due to the beveled profile, each of the first and second angles "A1", "B1" are greater than 90 degrees but less than 180 degrees. In the illustrated example of FIG. 3, each of the first side surface 164 and the second side surface 166 have the beveled profile. Alternatively, any one of the first side surface 164 and the second side surface 166 may have the beveled profile.

In other examples, wherein an overall height of the carriage 148 may be decided such that minimum material may accumulate on the carriage 148, each of the first side surface 164 and the second side surface 166 may have a flat profile. In such examples, each of the first angle "A1" and the second angle "B1" may be substantially equal to 90 degrees.

Further, the body portion 152 defines a number of first through-openings 170 (shown in FIG. 4) for receiving at least a portion of each of the number of shanks 178. Furthermore, the body portion 152 defines a number of first projections 168 (shown in FIG. 4), such that each first through-opening 170 is in communication with (e.g., being defined proximate to) a corresponding first projection 168. In some examples, the body portion 152 may be made of metal or alloys. In an example, the body portion 152 may be made of stainless steel, without any limitations.

The carriage 148 also includes a number of shank attachment portions 172 fixedly coupled to the body portion 152. Each shank attachment portion 172 extends from the second surface 162 of the body portion 152. The number of shank attachment portions 172 are spaced apart in a direction perpendicular to the first height "H1". The number of shank attachment portions 172 may be equidistant from each other between the lateral ends 158 (see FIG. 2). Further, each shank attachment portion 172 defines a second height "H2", such that the second height "H2" is equal to or greater than the first height "H1". In the illustrated example of FIG. 3, the second height "H2" is substantially equal to the first height "H1". The shank attachment portions 172 may be semicircular in shape. Alternatively, the shank attachment portions 172 may have a square shape, a rectangular shape, and the like. Further, the shank attachment portions 172 may be coupled to the body portion 152 using a joining technique, such as, welding, without any limitations.

Figure 4:
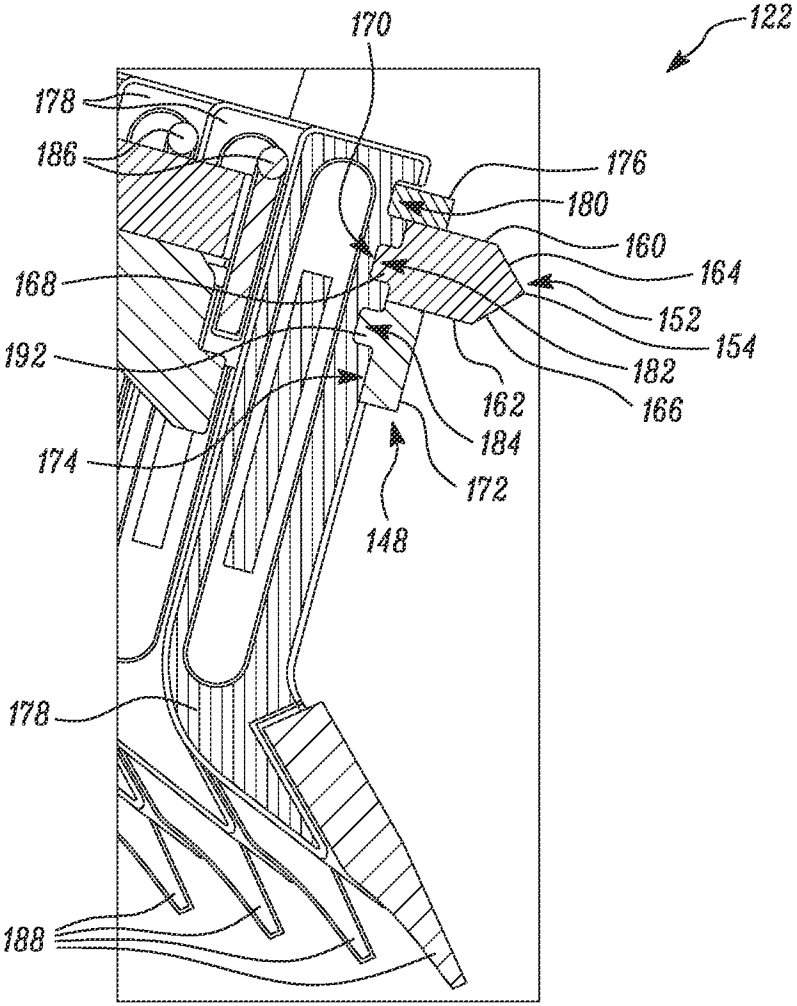
FIG. 4 is a cross-sectional view illustrating a portion of the carriage of FIG. 3.

Referring to FIG. 4, a cross-sectional view of a portion of the carriage 148 is illustrated. As illustrated in FIG. 4, each shank attachment portion 172 defines a second through-opening 174. The second through-opening 174 is in alignment with a corresponding first through-opening 170 from the number of first through-openings 170. Specifically, the first and second through-openings 170, 174 align to receive the shank 178. Further, each shank attachment portion 172 defines a second projection 192, such that the second through-opening 174 is in communication with (e.g., being defined proximate to) a corresponding second projection 192.

The carriage 148 further includes a number of shank retention elements 176 fixedly coupled to the body portion 152. Each shank retention element 176 extends from the first surface 160 of the body portion 152. The shank retention elements 176 are embodied as rectangular plate shaped members that may be coupled to the body portion 152 using a joining technique, such as, welding, without any limitations. In another example, the body portion 152, the shank attachment portions 172, and the shank retention elements 176 may be manufactured as a single piece component through a process, such as, casting. In some examples, the shank attachment portions 172 and the shank retention elements 176 may be made of metal or alloys. In an example, the shank attachment portions 172 and the shank retention elements 176 may be made of stainless steel, without any limitations.

As illustrated in FIG. 4, each shank 178 includes a number of grooves 180, 182, 184. The grooves 180, 182, 184 allow the shank 178 to be coupled with the carriage 148 at different positions. Further, the grooves 180, 182, 184 may allow adjustment of a cutting depth of the ground surface 120 (see FIG. 1), as per digging requirements. The grooves 180, 182, 184 are embodied as rectangular grooves herein.

As illustrated herein, the groove 180 receives a portion of the shank retention element 176 for engaging the shank 178 with the shank retention element 176. Further, the groove 182 receives the first projection 168 of the body portion 152 for engaging the shank 178 with the body portion 152. Moreover, the groove 184 receives the second projection 192 of the shank attachment portion 172 for engaging the shank 178 with the shank attachment portion 172. Further, the scarifier system 122 includes a number of locking elements 186. Each locking element 186 may lock the shank 178 with the body portion 152, a corresponding shank attachment portion 172, and a corresponding shank retention element 176.

Figure 5:
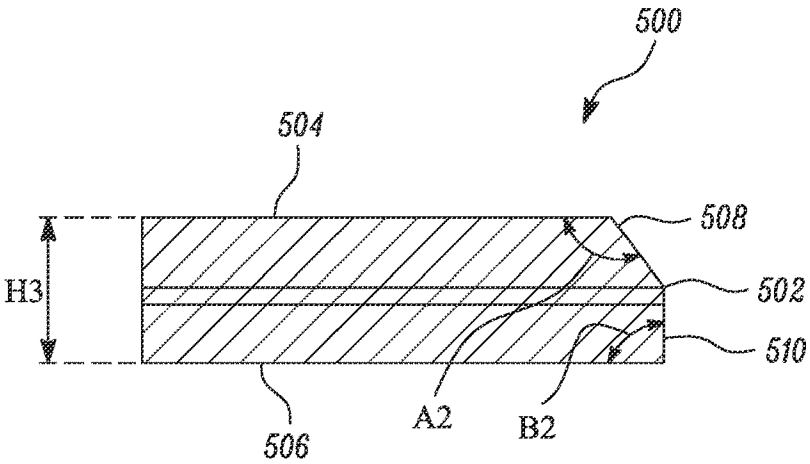
FIG. 5 is a schematic cross-sectional view illustrating a body portion associated with the carriage of FIG. 3, according to another embodiment of the present disclosure.

Referring to FIG. 5, a schematic cross-sectional view of a body portion 500 associated with the carriage 148 of FIG. 2 is illustrated, in accordance with another embodiment of the present disclosure. The body portion 500 may be substantially similar to the body portion 152 explained in relation to FIGS. 2, 3, and 4. The body portion 500 has a leading edge 502. Further, the body portion 500 includes a first surface 504 and a second surface 506 similar to the first and second surfaces 160, 162 explained in relation to FIGS. 2 and 3. The body portion 500 also includes a first side surface 508. The first side surface 508 connects the first surface 504 and the leading edge 502. The first side surface 508 is inclined with respect to the first surface 504 by a first angle "A2". In the illustrated example of FIG. 5, the first angle "A2" is greater than 90 degrees. The first side surface 508 includes a beveled profile. Due to the beveled profile, the first angle "A2" is greater than 90 degrees but less than 180 degrees.

The body portion 500 also includes a second side surface 510. The second side surface 510 connects the second surface 506 and the leading edge 502. In the illustrated example of FIG. 5, the second side surface 510 includes a flat profile. Further, a second angle "B2" is defined between the second side surface 510 and the second surface 506. The second angle B2 is substantially equal to 90 degrees. Furthermore, the body portion 500 has a first height "H3" defined between the first surface 504 and the second surface 506.

Figure 6:
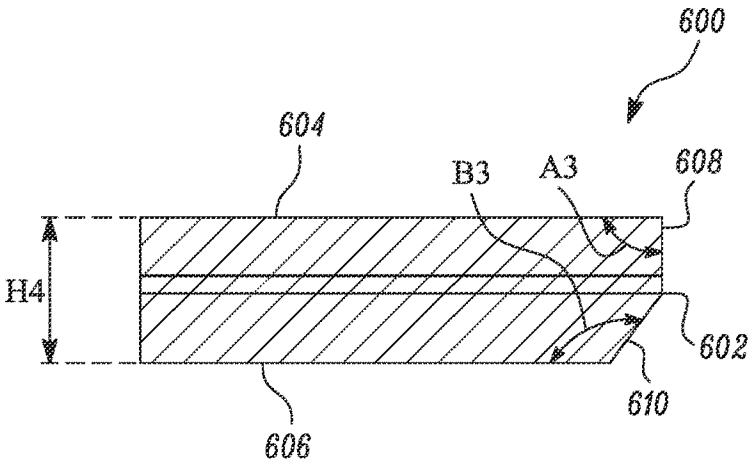
FIG. 6 is a schematic cross-sectional view illustrating a body portion associated with the carriage of FIG. 3, according to yet another embodiment of the present disclosure.

Referring to FIG. 6, a schematic cross-sectional view of a body portion 600 associated with the carriage 148 of FIG. 2 is illustrated, in accordance with another embodiment of the present disclosure. The body portion 600 may be substantially similar to the body portion 152 explained in relation to FIGS. 2, 3, and 4. The body portion 600 has a leading edge 602. Further, the body portion 600 includes a first surface 604 and a second surface 606 similar to the first and second surfaces 160, 162 explained in relation to FIGS. 2 and 3. The body portion 600 includes a first side surface 608. The first side surface 608 connects the first surface 604 and the leading edge 602. In the illustrated example of FIG. 6, the first side surface 608 includes a flat profile. Further, a first angle "A3" is defined between the first side surface 608 and the first surface 604. The first angle "A3" is substantially equal to 90 degrees The body portion 600 also includes a second side surface 610. The second side surface 610 connects the second surface 606 and the leading edge 602. The second side surface 610 is inclined with respect to the second surface 606 by a second angle "B3". In the illustrated example of FIG. 6, the second angle "B3" is greater than 90 degrees. The second side surface 610 includes a beveled profile. Due to the beveled profile, the second angle "B3" is greater than 90 degrees but less than 180 degrees. Further, the body portion 600 has a first height "H4" defined between the first surface 604 and the second surface 606. In some examples, the first height "H1" (see FIG. 3), the first height "H3" (see FIG. 5) and the first height "H4" may be substantially equal to each other.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The scarifier system 122 of the present disclosure includes the carriage 148. The body portion 152, 500, 600 of the carriage 148 defines the height "H1", "H3", and "H4", respectively, that are substantially less than a substantially vertical height of conventional carriages that have a thick box shaped design. In some examples, the height "H1", "H3", and "H4" of the body portion 152, 500, 600, respectively, may be about 60% less in comparison to a height of conventional carriages. Therefore, the carriage 148 of the present disclosure may be lighter weight and may be less costly as less material may be used to manufacture the carriage 148. Moreover, during operation, the reduced height "H1", "H3", and "H4" of the body portion 152, 500, 600, respectively, may prevent excess material build-up on the body portion 152, 500, 600.

Further, the carriage 148 includes the first side surface 164, 508, 608 and the second side surface 166, 510, 610. In some embodiments, the first side surface 164, 508 and the second side surface 166, 610 include the beveled profile. The beveled profile of the first side surface 164, 508 and/or second side surface 166, 610 may provide the carriage 148 with a streamlined design that may prevent material build-up on the body portion 152, 500, 600. Specifically, each of the first side surface 164, 508 and the second side surface 166, 610 having the beveled profile may act as an aerodynamic surface. Such aerodynamic surfaces may prevent the accumulation of the material on the carriage 148 during work operations, such as, cutting or digging. It should be noted that the first angles "A1", "A2", "A3" of the first side surface 164, 508, 608 and the second angles "B 1", "B2", "B3" of the second side surface 166, 510, 610 may be increased so as to improve an aerodynamic profile of the carriage 148. In some examples, wherein the overall height of the carriage 148 may be decided such that minimum material may accumulate on the carriage 148, each of the first side surface 164, 508, 608 and the second side surface 166, 510, 610 may have a flat profile. In such examples, the first angle "A1", "A2", "A3" and the second angle "B1", "B2", "B3" may be substantially equal to 90 degrees.

The design of the carriage 148 as described herein may reduce a drag on the carriage 148 due to reduction of the material build-up thereon, which may allow the carriage 148 to push more material during various work operations. Moreover, as the carriage 148 may experience reduced resistance, a force required to push the scarifier system 122 may decrease, and a cut force for performing work operations may increase. Further, the increase in the cut force may allow the scarifier system 122 to dig deeper and faster. Furthermore, the design of the carriage 148 may increase an efficiency of the scarifier system 122 and may also improve a fuel efficiency of the machine 100 as the drag on the carriage 148 during the work operations may be reduced. Moreover, the carriage 148 described herein may be retrofitted on existing scarifier systems without changing a design of existing scarifier systems. Additionally, the carriage 148 is designed such that the carriage 148 may be compatible with conventional shanks.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A carriage for a scarifier system of a machine, the carriage comprising:

a V-shaped body portion having a leading edge, a trailing edge, a first height, a first through-opening, and a second through-opening vertically spaced apart in a direction of the first height and axially aligned with the first through-opening, the body portion including:

a first surface;

a second surface spaced apart from the first surface, such that the first height of the body portion is defined between the first surface and the second surface;

a first side surface connecting the first surface and the leading edge; and a second side surface connecting the second surface and the leading edge, wherein at least one of the first side surface and the second side surface includes a beveled profile and a length extending from the respective first or second surface to the leading edge that is longer than a length of the leading edge in a vertical direction; and a plurality of shank attachment portions fixedly coupled to the body portion, wherein each shank attachment portion extends from the second surface of the body portion, each shank attachment portion defining a second height.

2. The carriage of claim 1, wherein the scarifier system further includes a plurality of shanks coupled to the carriage, wherein the scarifier system further includes a plurality of teeth adapted to engage with a ground surface, and wherein each tooth from the plurality of teeth is coupled to a corresponding shank from the plurality of shanks.

3. The carriage of claim 2, wherein the first through-opening is configured to receive at least a portion of one of the plurality of shanks.

4. The carriage of claim 1, wherein the first side surface is inclined with respect to the first surface by a first angle, the first angle being equal to or greater than 90 degrees.

5. The carriage of claim 1, wherein the second side surface is inclined with respect to the second surface by a second angle, the second angle being equal to or greater than 90 degrees.

6. The carriage of claim 1, wherein the body portion includes a continuous plate member.

7. A carriage for a scarifier system of a machine, the carriage comprising: a body portion having a leading edge, a trailing edge, a first height, a first through-opening, and a second through-opening vertically spaced apart in a direction of the first height and axially aligned with the first through-opening, the body portion including:

a first surface;

a second surface spaced apart from the first surface, such that the first height of the body portion is defined between the first surface and the second surface;

a first side surface connecting the first surface and the leading edge; and a second side surface connecting the second surface and the leading edge; and a plurality of shank attachment portions fixedly coupled to the body portion, wherein each shank attachment portion extends a second height from the second surface of the body portion, wherein the plurality of shank attachment portions are spaced apart in a direction perpendicular to the first height, wherein the second height is defined between the second surface of the body portion and an end of the shank attachment portion furthest from the body portion, and wherein the second height of the shank attachment portions is equal to or greater than the first height of the body portion.

8. The scarifier system of claim 7 further comprising a plurality of shanks coupled to the carriage.

9. The scarifier system of claim 7, wherein the first side surface is inclined with respect to the first surface by a first angle, the first angle being equal to or greater than 90 degrees.

10. The scarifier system of claim 7, wherein the second side surface is inclined with respect to the second surface by a second angle, the second angle being equal to or greater than 90 degrees.

11. The scarifier system of claim 7, wherein the body portion includes a continuous plate member having a substantially V-shaped configuration.

12. The scarifier system of claim 7 further comprising a pair of coupling plates coupled to corresponding lateral ends of the body portion, wherein the coupling plates allow coupling of the scarifier system with a frame of the machine.

13. A carriage for a scarifier system of a machine, the carriage comprising:

a body portion having a leading edge, a trailing edge, a first height, the body portion including:

a first surface;

a second surface spaced apart from the first surface, such that the first height of the body portion is defined between the first surface and the second surface;

a first side surface connecting the first surface and the leading edge; and a second side surface connecting the second surface and the leading edge, wherein at least one of the first side surface and the second side surface includes a beveled profile and a length extending from the respective first or second surface to the leading edge that is longer than a length of the leading edge in a vertical direction;

a plurality of shank attachment portions fixedly coupled to the body portion, wherein each shank attachment portion extends from the second surface of the body portion, wherein each shank attachment portion defines a second height between the second surface of the body portion and an end of the shank portion furthest from the body portion, the second height being equal to or greater than the first height of the body portion; and a plurality of shank retention elements fixedly coupled to the body portion, wherein each shank retention element extends from the first surface of the body portion.

14. The machine of claim 13 further comprising a plurality of shanks coupled to the carriage.

15. The machine of claim 13, wherein the first side surface is inclined with respect to the first surface by a first angle, the first angle being equal to or greater than 90 degrees.

16. The machine of claim 13, wherein the second side surface is inclined with respect to the second surface by a second angle, the second angle being equal to or greater than 90 degrees.

17. The machine of claim 13, wherein the body portion includes a continuous plate member having a substantially V-shaped configuration.

18. The carriage of claim 1, wherein the first side surface is inclined with respect to the first surface by a first angle, the first angle being greater than 90 degrees, and wherein the second side surface is inclined with respect to the second surface by a second angle, the second angle being substantially equal to 90 degrees.

19. The scarifier system of claim 7, wherein the first side surface is inclined with respect to the first surface by a first angle, the first angle being substantially equal to 90 degrees, and wherein the second side surface is inclined with respect to the second surface by a second angle, the second angle being greater than 90 degrees.

20. The carriage of claim 13, wherein the body portion further has a first through-opening and a second through-opening vertically spaced apart in a direction of the first height and axially aligned with the first through-opening.

* * * * *